United States Patent [19]

Baggio

[11] Patent Number: 4,712,316

[45] Date of Patent: Dec. 15, 1987

[54] SKI BOOT WITH A DEVICE FOR SECURING THE FOOT OF THE SKIER

[75] Inventor: Giorgio Baggio, San Martino di Lupari, Italy

[73] Assignee: Nordica S.p.A., Montebelluna Tv, Italy

[21] Appl. No.: 898,564

[22] Filed: Aug. 21, 1986

[30] Foreign Application Priority Data

Sep. 9, 1985 [IT] Italy ..... 22087 A/85

[51] Int. Cl.[4] ..... A43B 5/04; A43B 7/14

[52] U.S. Cl. ..... 36/119; 36/1; 36/93

[58] Field of Search ..... 36/117-121, 36/93, 88, 71, 1

[56] References Cited

U.S. PATENT DOCUMENTS

| | | | |
|---|---|---|---|
| 4,388,594 | 6/1983 | Deskins et al. | 36/1 X |
| 4,583,305 | 4/1986 | Miyamoto | 36/119 |
| 4,631,843 | 12/1986 | Annovl | 36/119 |
| 4,654,986 | 4/1987 | George | 36/119 |
| 4,662,087 | 5/1987 | Beuch | 36/119 |

FOREIGN PATENT DOCUMENTS

| | | | |
|---|---|---|---|
| 0155908 | 9/1985 | European Pat. Off. | 36/117 |
| 2845824 | 5/1979 | Fed. Rep. of Germany | 36/93 |
| 3310812 | 9/1984 | Fed. Rep. of Germany | 36/117 |
| 3427644 | 1/1986 | Fed. Rep. of Germany | 36/117 |
| 2568454 | 2/1986 | France | 36/117 |

*Primary Examiner*—James Kee Chi

*Attorney, Agent, or Firm*—Guido Modiano; Albert Josif

[57] ABSTRACT

The present invention relates to a ski boot with a device for securing the foot of the skier. The device has the peculiarity of comprising an minicompressor associated with the boot, which can be connected to an electrical power source and operated by controls to feed compressed fluid into an inflatable chamber which can draw close to the foot of the skier for the securing thereof in said boot.

20 Claims, 16 Drawing Figures

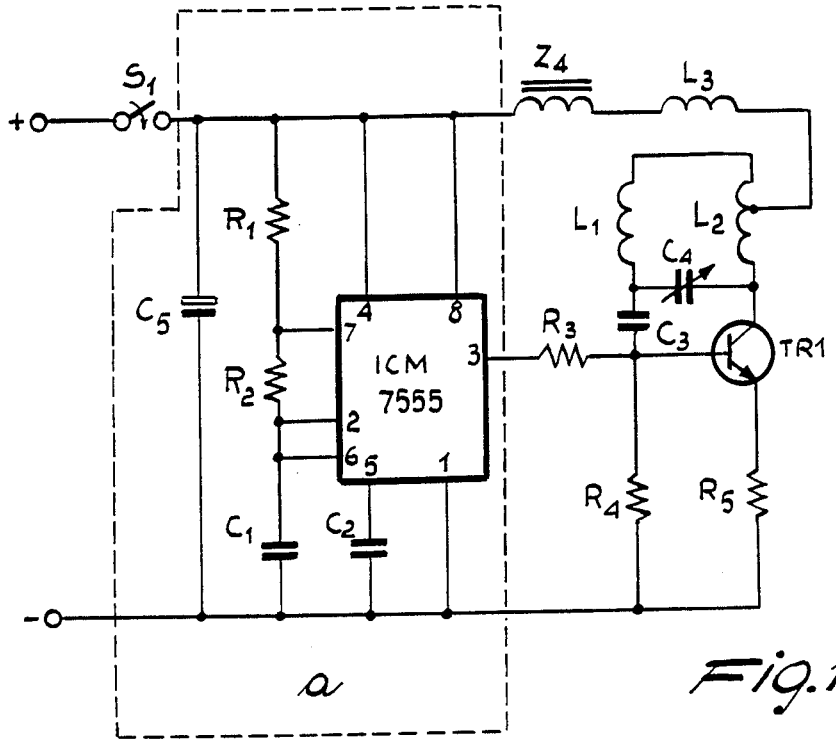
Fig. 11
Fig. 13
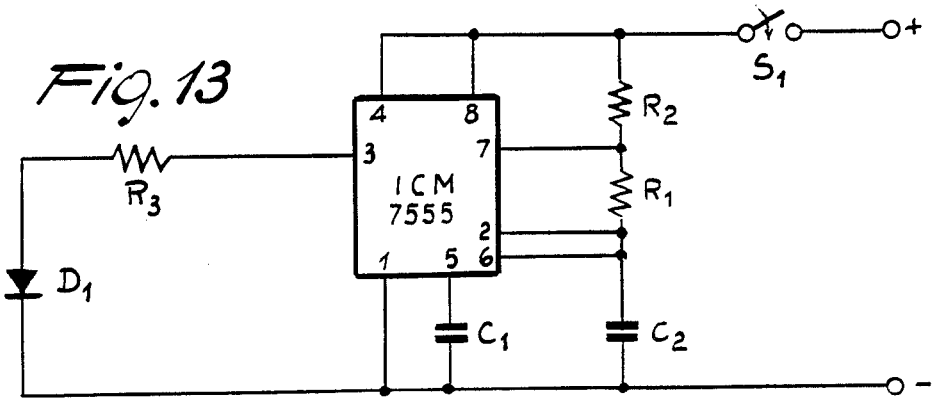
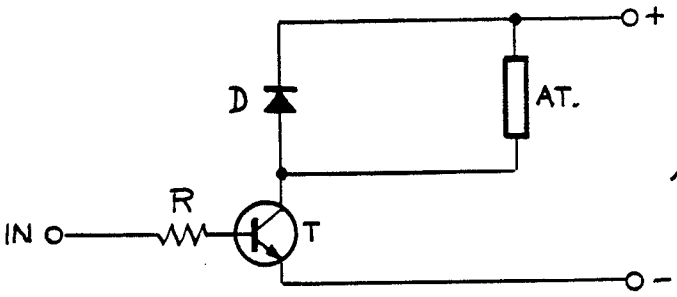
Fig. 15

SKI BOOT WITH A DEVICE FOR SECURING THE FOOT OF THE SKIER

BACKGROUND OF THE INVENTION

The present invention relates to a ski boot with a device for securing the foot of the skier.

Countless devices are known for securing the foot of the skier in ski boots.

Particularly, the use is known of air-chambers placed inside the boot which, when inflated, progressively reduce the internal volume of the boot, thus effecting securing of the foot.

These air-chambers are currently inflated by means of a manual pumping system which is completely incorporated into the boot, or is partially incorporated into the boot and partially detachable.

These known kinds of devices, however, are not free from disadvantages.

Indeed, if the system, including the manually operated pump, is completely incorporated into the boot, the necessarily small dimensions of the pump significantly increase the time required to obtain satisfactory securing of the foot.

If a detachable external pumping means is employed, it is necessary for the skier to stay bent over the boot to perform the operation, in an uncomfortable and unsafe position, besides the inconvenience of having to store and carry the external pump separately.

SUMMARY OF THE INVENTION

The main general aim of the present invention is to eliminate the above described disadvantages by providing a ski boot with a device for securing the foot of the skier, which can obtain the inflating of air-chambers which are internal to the boot, in a short time and without forcing the skier to assume uncomfortable and unsafe positions.

Within the scope of this aim, an object of the invention is to provide a device which can be also used for the external and/or internal closing of the boot to obtain the securing of the foot.

A further object of the invention is to provide a device which has great operating simplicity and a high reliability.

This aim, as well as this and other objects which will better appear hereinafter, are achieved, by a ski boot with a device for securing the foot of the skier, characterized in that it comprises motorized electropneumatic means, with autonomous operation, associated with the boot, which means can be connected to an electrical power source and can be operated by controls to feed compressed fluid into securing means which can draw close, with at least one of their parts, to the foot of the skier to contribute towards its securing in said boot.

The above defined solution of the general problem entails the following subordinate problems inherent in the embodiment of the claimed securing device and in its positioning within the boot:

reduction in the dimensions, especially of the depth, of at least one of the components of the device, positioning of the device in the parts of the boot where its weight and dimensions have the smallest influence on the efficient operation of the boot.

BRIEF DESCRIPTION OF THE DRAWINGS

Further features and advantages will become better apparent from the description of a preferred, but not exclusive, embodiment of the device according to the invention, illustrated, by way of non-limitative example only, in the accompanying drawings, where:

FIG. 11 is the circuit diagram of a radio-wave transmitter for the remote control of the securing device according to the invention;

FIG. 13 is the circuit diagram of an infrared-ray transmitter of the remote control of the securing device according to the invention;

FIG. 15 is a view of a typical connection between the final transistor of the receiving device and the actuators of the securing device.

DESCRIPTION OF THE PREFERRED EMBODIMENTS

Figure 1:
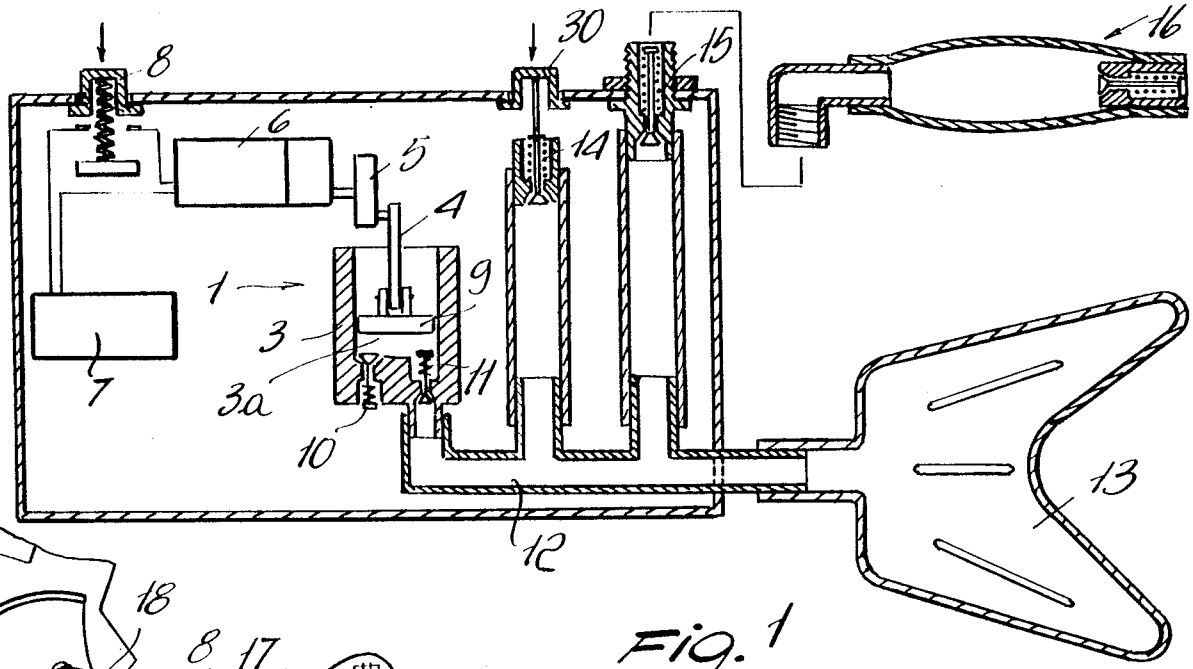
FIG. 1 is a schematic view of the device according to the invention in the application for inflating an inflatable chamber.

With reference to the figures, the device according to the invention comprises electropneumatic means, composed of an electric minicompressor 1, having dimensions such as to be incorporated into a ski boot 2, which can be essentially composed of an alternating pump 3 operated by means of a connecting rod 4 by an eccentric 5 associated with the output of an electric gear motor 6.

The electric gear motor 6 is powered by means of accumulators or batteries 7 accommodated in a space provided in the boot in a box associated thereto. On the circuit connecting the accumulators 7 to the gear motor, an operating button 8 is provided, which is accessible from the outside of the boot and can be operated even with the point of the ski-stick. This operating button can be replaced by an electronic device which in any case performs the opening or closing function of the power supply circuit of the minicompressor and can be controlled by a remote control of a known kind, placed inside the handle of the ski-stick, or be pocket-sized or fixed to the wrist like a watch.

The alternating pump 3 is composed of a substantially cylindrical chamber 3*a*, in which a piston 9 slides, which is associated with the small connecting rod 4, which is provided with an intake valve 10 and a delivery valve 11. This delivery valve 11 is connected through a conduit 12 to the securing means according to the invention.

These securing means can be composed of an inflatable chamber 13 associated with the internal surface of the boot. Naturally, more than one inflatable chamber can be provided, located in more than one point of the boot according to requirements. In the case illustrated, an inflatable chamber has been provided at the instep of the skier's foot.

The inflatable chamber 13 furthermore communicates with a discharge valve 14, accessible from the outside of the boot, to allow the deflation of the inflatable chamber when it is desired to disengage the foot from the boot, or when it is desired to reduce the pressure in the inflatable chamber. To actuate this discharge valve 14, a button 30 can be provided which protrudes out of the boot and can be operated, similarly to the operating button 8, with the point of the ski-stick.

The inflatable chamber 13 is connected to an emergency valve 15, also accessible from the outside of the boot, for the manual inflation of the inflatable chamber in case the minicompressor develops a fault, or if the accumulators or batteries are drained. In these cases, a manual pump 16 of a known kind can be applied to the valve 15.

The securing means can be composed of pneumatic actuators, such as small pistons not illustrated in the figure, connected with the elements which usually obtain the closing of the boot around the foot of the skier, replacing or limiting the manual interventions in this operation.

Indeed, it is possible to arrange pneumatic actuators which press or pull movable parts, either hinged on one side or completely uncoupled, suitable both for the external closing (quarters) and for the internal closing (coller/instep) allowing for the securing of the foot.

The device according to the invention can be assembled on the boot in several manners.

Figure 2:
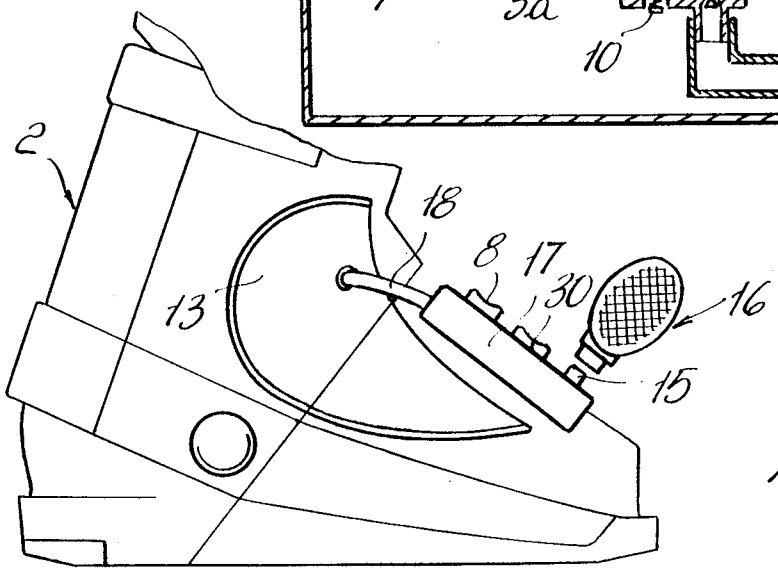
FIGS. 2 to 7 are views of the device in the different arrangements, applied to the ski boot, which is depicted in a see-through manner for the sake of clarity.

As is shown in FIG. 2, the entire device can be clustered into a single box 17 positioned onthe upper portion of the shell. From the box 17, tubes 18 exit, which connect the minicompressor and the various valves described to the inflatable chamber 13 or to the pneumatic actuators.

Figure 3:
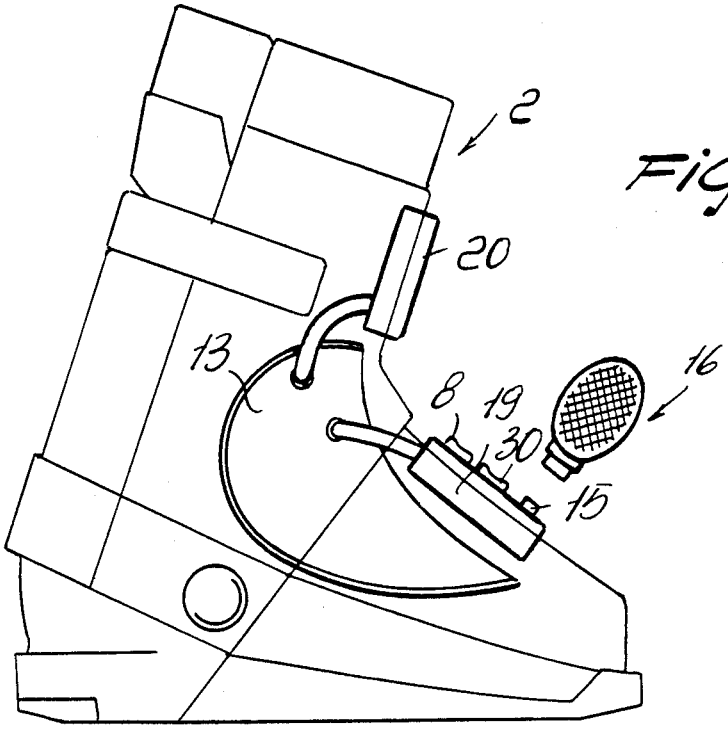

As is shown in FIG. 3, two boxes 19 and 20 can be provided, one of which is placed on the top part of the shell and one on the front quarter of the boot. The box 19 accommodates the operating button 8, the discharge button 30 and the emergency valve 15, while the minicompressor is accommodated in the box 20. Naturally the connections between the various components of the device and to the inflatable chamber or with the pneumatic actuators are achieved by means of electrical circuits or wires and tubes accommodated inside the boot.

Figure 4:
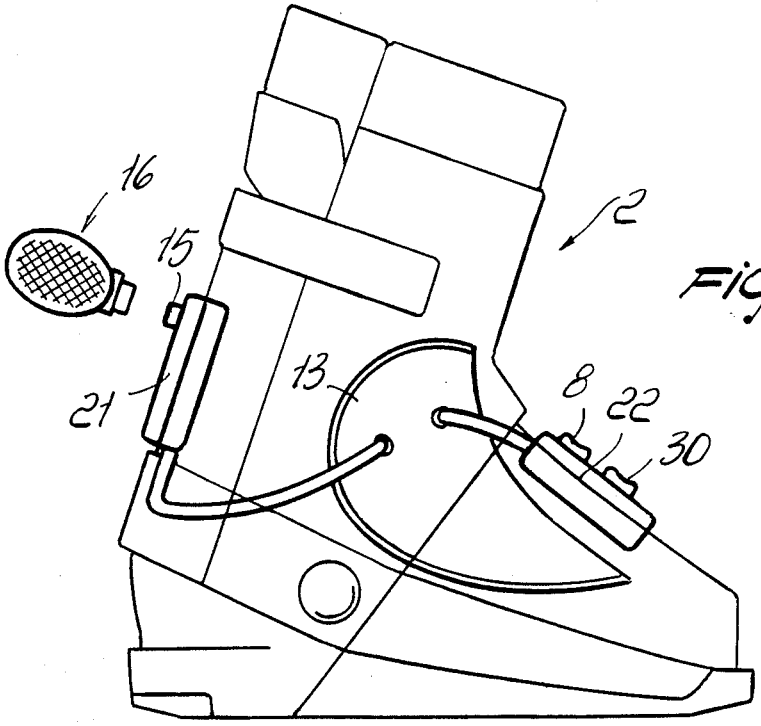

A further example of arrangement of the components of the device is illustrated in FIG. 4. In this case, the emergency valve and the minicompressor are accommodated in a box 21 placed on the rear quarter of the boot, while the other components are accommodated in a box 22 associated, as in the preceding cases, with the upper portion of the base.

Apart from these arrangements, which are described to stress the great adaptability of the device, other arrangements may be adopted, in which the various components can be clustered into a single box or positioned in different points, connected to each other by means of tubes and electric wires according to requirements.

Figure 5:
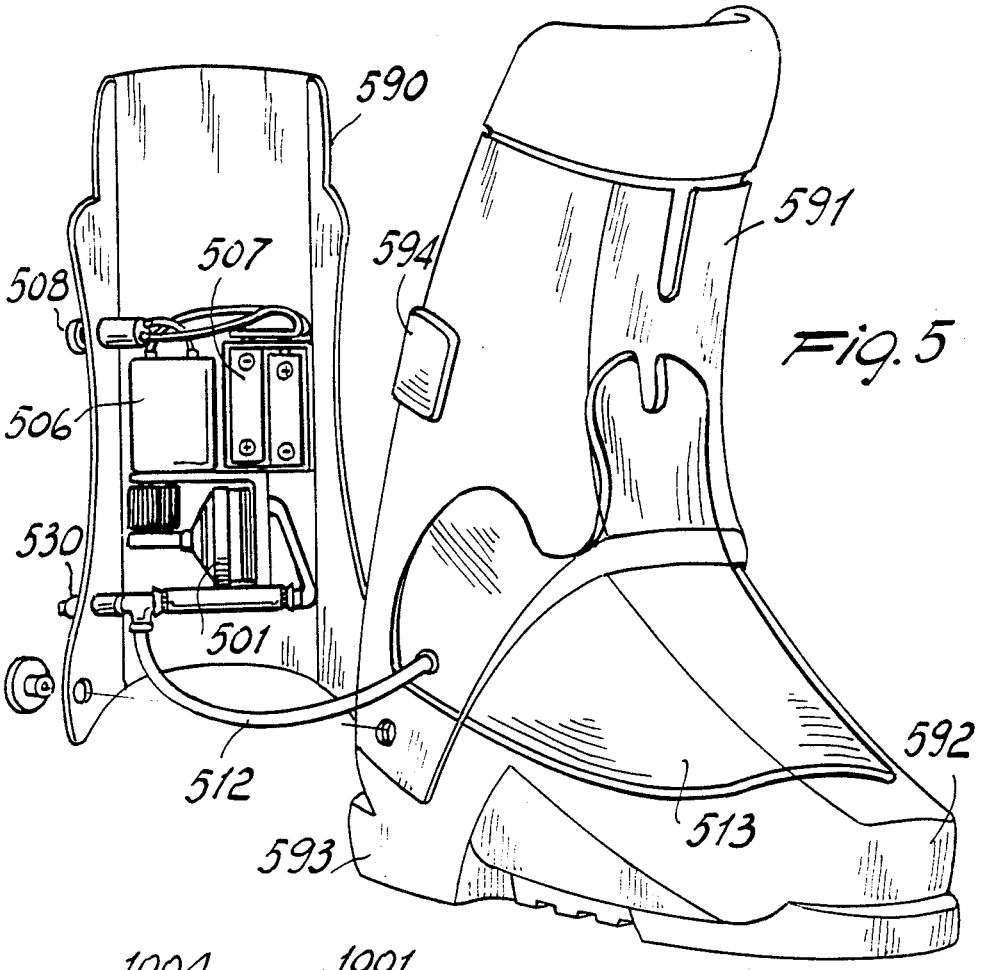
Figure 6:
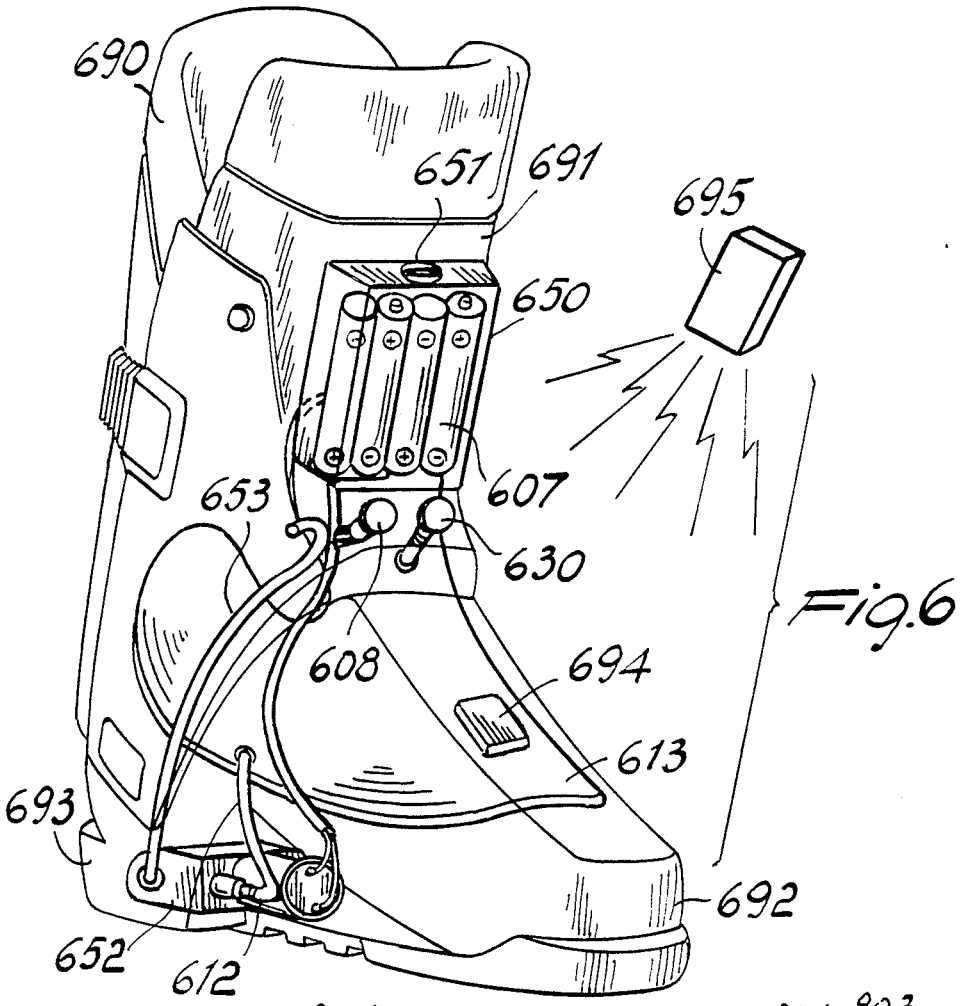
Figure 7:
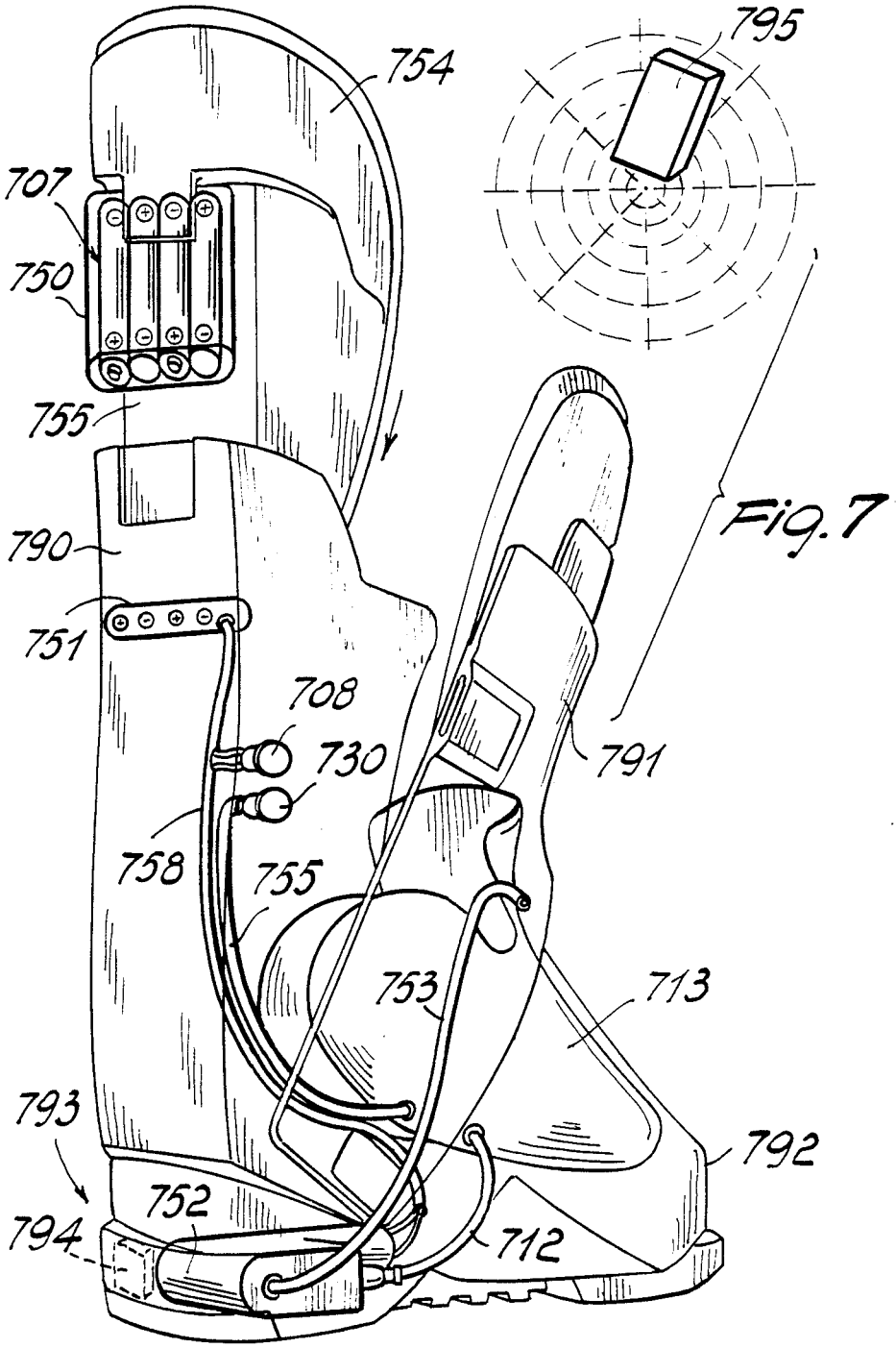
Figure 12:
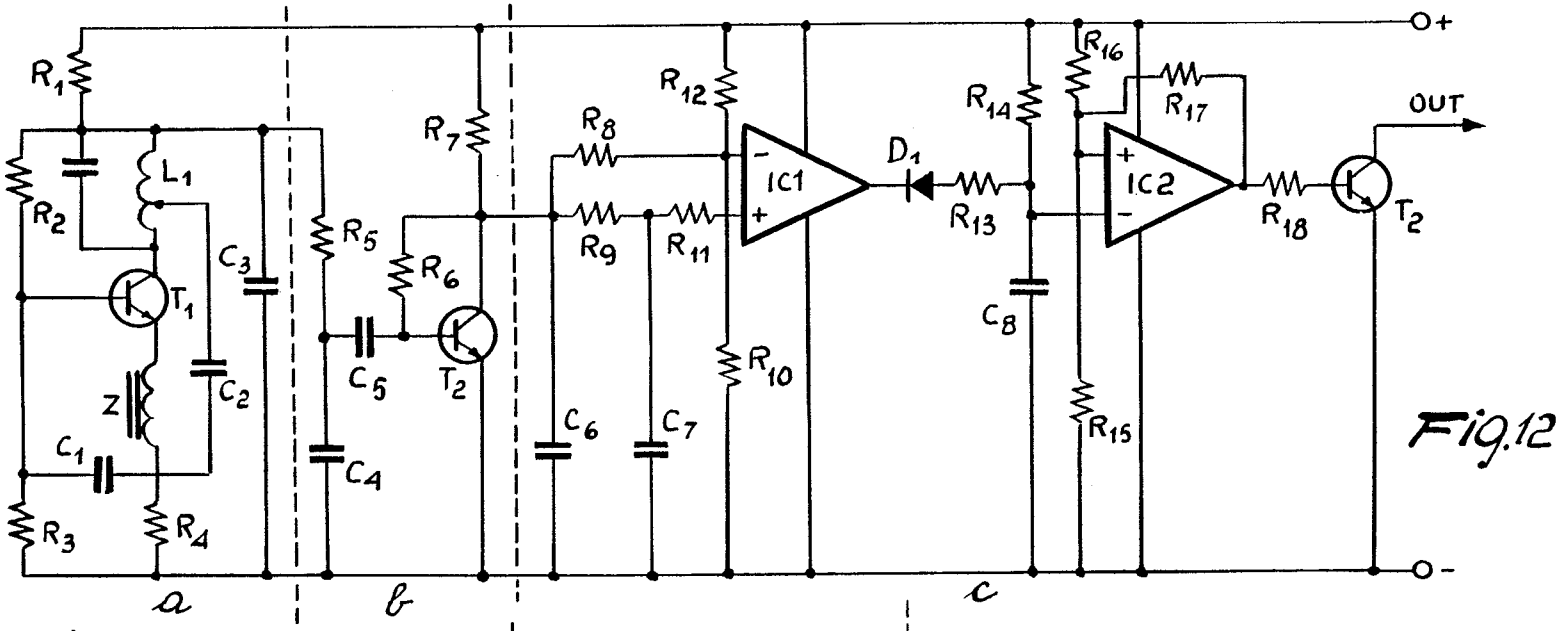
FIG. 12 is the circuit diagram of a receiver, cooperating with the transmitter of FIG. 12.
Figure 14:
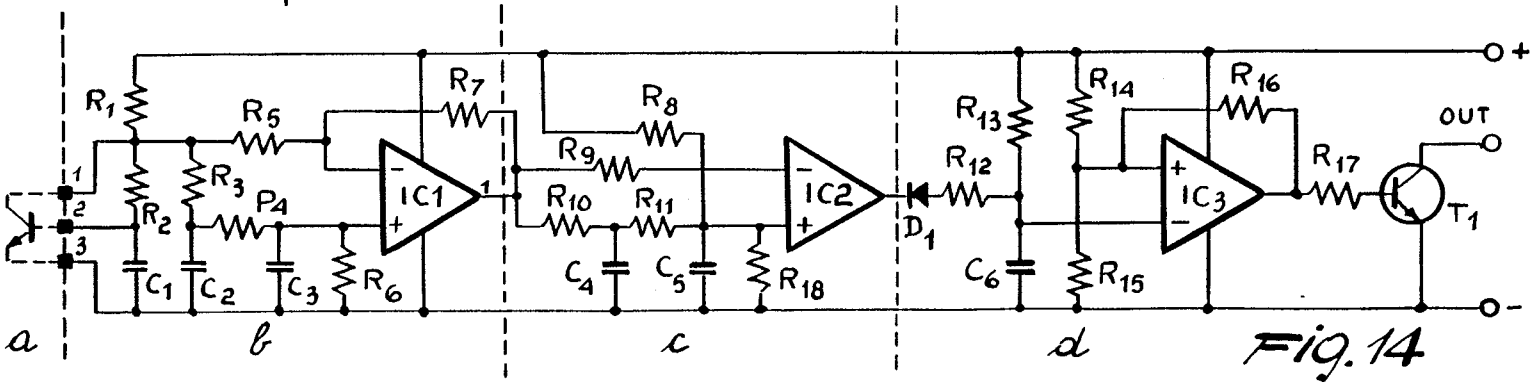
FIG. 14 is the circuit diagram of a receiver cooperating with the infrared transmitter.

Thus, as an example, in FIGS. 5, 6 and 7 various arrangements are shown of the parts composing the device. In these figures, the component parts already illustrated in FIGS. 1 to 4 have been referenced with a numeral which is obtained by respectively adding 500, 600 and 700 to the reference numeral of the matching component part illustrated in FIGS. 1 to 4, so that the re-description of these component parts is omitted. It should be noted that in FIGS. 5, 6 and 7 the rear quarter is indicated repsectively with the reference numeral 590, 690, 790, the front quarter respectively with 591, 691, 791, the shell with the reference numeral respectively 592, 692, 792, the heel respectively with 593, 693, 793.

In FIG. 5 the reference numeral 594 indicates the receiver for the infrared remote control, which is placed on the rear quarter and will be described hereinafter.

In the FIGS. 6 and 7, the motor/compressor ssembly has been identified respectively with the reference numerals 652 and 752, the container or housing for the accumulators with 650 and 750, the intake tube with 653 and 753 respectively. In FIG. 6 the sealing closure 651 is also visible, and in FIG. 7 the vent tube 755 is visible, naturally positioned inside the shell as ar also the other tubes and wires. Furthermore, the rear quarter comprises a padding 754 which forms an interspace in which the battery cluster or the accumulator 707 is placed. Even if the padding is glued or riveted to the internal surface of the rear quarter, the interspace is accessible for the possible removal of the accumulators, which can also be of the rechargeable type, in which case their extraction is not necessary, since circuital connections are provided which allow for recharging.

In FIG. 6, the receiver 694 for the infrared remote control is placed on the shell 692 in the zone of the foot instep, and the infrared transmitter is referenced with 695. In FIG. 7, the receiver 794 of the radio-wave remote control is built-in in the heel of the boot, and the related transmitter is indicated with the reference numeral 795.

Figure 8:
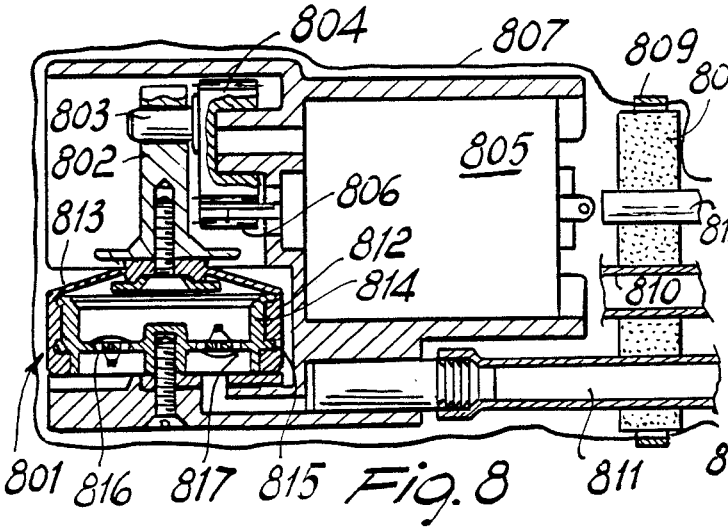
FIG. 8 is an axial cross section view along an assembly composed of an electric motor and a minicompressor according to yet another embodiment.
Figure 9:
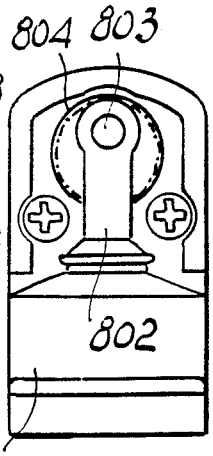
FIG. 9 is a front view to the assembly illustrated in FIG. 8.

FIGS. 8 and 9 illustrate a motor/compressor cluster which is particularly suitable for the application according to the present invention. Indeed, the cluster is relatively flat and is also visible in FIG. 5. It has an elastic membrane 801, to which an alternating vertical motion is imparted through the connecting rod 802, which converts the rotating motion of the electric motor 805 into alternating motion, as it is keyed to the small axle 803 which is mounted eccentric on the toothed wheel 804, which engages with the pinion 806 of the electric motor 805. The cluster is advantageously contained in a sack 807, expediently made of plastic material, such as "nylon". The open end of the sack is closed by a stopper 808, preferably in rubber, which is pressed against the sac by a locking clip 809 and through which pass the intake tube 810, the delivery tube 811 and the two-conductor wire. The membrane 801 usually has the shape of a bell with a fixed peripheral part 812 and a vibrating disk-like or oval part 813. The peripheral part encircles a box-like valve body 814, open upwardly and covered by the disk-like part 813 of the membrane, the bottom 815 of which is provided with an intake valve 816 and with a delivery valve 817. It should be noted that the axis of the membrane is arranged perpendicular to the axis of the electric motor, which arrangement confers the cluster with the necessary compactness and flat shape for being positioned in the structure of the boot. The sack-like structure protects the cluster from moisture, on one hand, and on the other hand allows the cluster to have the necessary versatility and flexibility as far as the tube and conduit are concerned.

Figure 10:
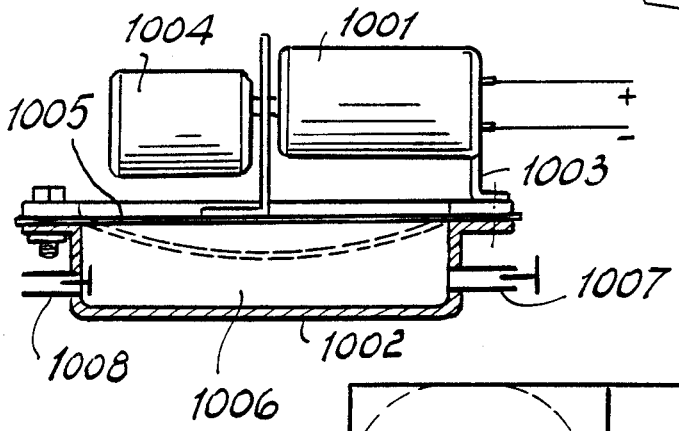
FIG. 10 is a front view of an assembly composed of an electric motor and a membrane minicompressor according to another embodiment.
Figure 8A:
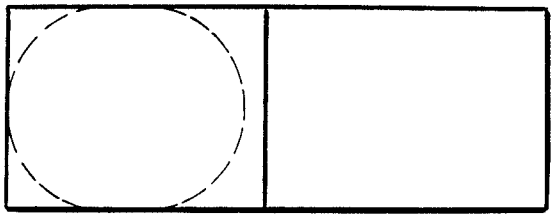
FIG. 8*a* is a top view of FIG. 8.

The motor/membrane compressor cluster illustrated in FIG. 10 is distinctive due to its simplicity, efficiency and small dimensions and weight. It is provided with an electric motor 1001 protrudingly fixed on the box-like valve body 1002 by means of an elastic arm 1003 which allows the motor to oscillate. To the axle of the motor a mass 1004 is fixed, the center of gravity of which is positioned eccentrically with respect to the motor axle, so that the rotation of the motor gives rise to vibrations, which are countered by the arm 1003. The vibrations are transmitted to the membrane 1005 which covers the compression chamber 1006. The delivery valves 1007 and intake valves 1008 cooperate to create the pumping effect. It should be noted that this small compressor does not require reducing gears, which reduces the dimensions and the weight. Due to its characteristics, it can also be used autonomously as a portable emergency compressor or as an autonomous pump for boots which do not have the compressor built-in.

Within the scope of the invention is also the remote control of the actuators of the securing device, and in particular of the electric motor of the compressor. The circuit diagrams including switch means illustrated in FIGS. 11 to 15 are sufficiently self-explanatory with their symbols for an expert in the field and do not require particular descriptions. It should be noted, on this subject, that the problem of remote control, for which the solutions have been indicated in the circuit diagrams illustrated in the drawings, implied the conditioning of the transmission of the control signals so as to avoid interference with nearby users, on one hand, and, on the other hand, a comfortable orientation of the transmitter towards the receiving point of the receiver, the positioning of which must be compatible with the structure and the component parts of the boot.

After what has been described, the operation of the device according to the invention is evident.

After putting on the boot 2, the skier, by using the point of the ski-stick, or with a finger, depresses the operating button 8.

In the case of a remote control, the user merely presses the button of the transmitter. The minicompressor 1, 501, 652, 752 starts pumping compressed fluid, generally air, which can be used, according to the applications, to inflate one or more inflatable chambers 13, 513, 613, 713 so as to secure the foot in the boot, or to feed the pneumatic actuators which act upon the closures of the boot as already described.

When it is desired to remove the foot from the boot, it is sufficient to act, again with the point of the ski-stick or with a finger, on the button 30, 530, 630, 730 of the discharge valve 14 so as to cause the deflation of the inflatable chamber 13, 513, 613, 713 or, in the case of the use of pneumatic actuators, so as to cause the discharge of the air which feeds them.

In practice, it has been observed that the device according to the invention fully achieves the aim proposed, obtaining quickly and effortlessly for the skier the securing of the foot in the boot.

A further advantage is that of having incorporated into the boot an electropneumatic system which can be used to operate by controls various devices associated with the boot.

The device thus conceived is susceptible of numerous modifications and variations, all of which are within the scope of the inventive concept, furthermore all the details are replaceable with technically equivalent elements.

Practically, the materials employed, as well as the dimensions, can be any according to the requirements and to the state of the art.

I claim:

1. In a ski boot having a boot structure with internal surface defining internally a wearer's foot location and including a shell structure with a heel portion, an instep portion and a sole portion and an upper structure with a front portion and a rear portion, in combination, an electropneumatic device for securing the foot of the skier within the ski boot, comprising inflatable means in the reach of said wearer's foot location within said ski boot and electrically actuated fluid pressure supplying means including, a compressor unit comprised of an electric motor, pumping means and mechanical transmission means for actuating said pumping means by said electric motor through said transmission means, electrical energy storage means located in said boot structure and spaced from said compressor unit, circuit means with conductor means for connecting said electric motor with said electric energy storage means and duct means connecting said inflatable means with said pumping means and wherein said boot structure further defines a chamber for containing therein at least said said compressor unit and having therein a sealing bag means enclosing at least said compressor unit and having stopper means with openings for the passage therethrough of said duct means and said conductor means.

2. A device according to claim 1, wherein said inflatable means comprise infatable bladder means associated with said internal surfaces of said boot structure.

3. A device according to claim 1, wherein said inflatable bladder means are associated with said internal surface at said instep portion.

4. A device according to claim 1, wherein said inflatable means comprise a discharge valve accessible from the outside to deflate upon actuation said inflatable means.

5. A device according to claim 1, further comprising an emergency valve accessible from the outside from connecting said emergency valve with external inflating means for inflating said inflatable means.

6. A device according to claim 1, wherein said rear portion of said upper structure is a rear quarter with an inner surface and having internally a padding element facing said inner surface and defining an interspace therebetween for receiving therein said electric energy storage means, said electric energy storage means comprising storage battery elements.

7. A device according to claim 1, wherein said front portion of said upper structure is a front quarter having a housing formation for receiving therein said electric energy storage means, said electric energy storage means comprising storage battery elements.

8. A device according to claim 1, wherein said circuit means comprise electromagnetically remote controlled switch means.

9. A device according to claim 1, wherein said electromagnetically remote controlled switch means comprise an infrared waves receiving element fixed on the instep portion of said shell structure.

10. A device according to claim 1, wherein said electromagnetically remote controlled switch means comprise a radio-wave receiver element built-in in said heel portion of said shell.

11. A device according to claim 1, wherein said pumping means of said compressor unit comprise a bell shaped membrane having a bell axis and lateral walls encircling a box-like valve body and a vibrating disk-like top wall extending transverse to said bell axis and wherein said mechanical transmission means impart a vibration of said top wall in the direction of said bell axis and wherein said electric motor has a rotation axis perpendicular to said bell axis.

12. A device according to claim 1, wherein said pumping means of said compressor unit comprise a box-like compression chamber having a top cover in the form of a membrane and valve means for air admission and delivery, an eccentric mass supported at leat partially onto said membrane and said electric motor imparting rotatory motion to said eccentric mass thereby to create vibrations transmitted to said membrane.

13. In a ski boot having a boot structure with internal surfaces defining internally a wearer's foot location and including a shell structure with a heel portion, an instep portion and a sole portion and an upper structure with a front portion and a rear portion, in combination, an electropneumatic device for securing the foot of the skier within the ski boot, comprising infatable bladder means associated with said internal surfaces of said boot structure in the reach of said wearer's foot location within said ski boot and electrically actuated fluid pressure supplying means including, a compressor unit comprised of an electric motor, pumping means and mechanical transmission means for actuating said pumping means by said electric motor through said transmission means, electrical energy storage means located in said boot structure and spaced from said compressor unit, circuit means with conductor means for connecting said electric motor with said electric energy storage means and duct means connecting said inflatable means with said pumping means and wherein said boot structure further comprises an emergency valve accessible from the outside for connecting said emergency valve with external inflating means for inflating said inflatable means.

14. A device according to claim 13, wherein said inflatable bladder means comprise a discharge valve accessible from the outside to deflate upon actuation said inflatable means.

15. A device according to claim 13, wherein said boot structure further defines a chamber for containing therein said compressor unit and having therein a sealing bag means enclosing said compressor unit and having stopper means with openings for the passage therethrough of said duct means and said conductor means.

16. A device according to claim 13, wherein said circuit means comprise electromagnetically remote controlled switch means.

17. A device according to claim 13, wherein said electromagnetically remote controlled switch means comprise an infrared waves receiving element fixed on the instep portion of said shell structure.

18. A device according to claim 13, wherein said electromagnetically remote controlled switch means comprise a radio-wave receiver element built-in in said heel portion of said shell.

19. A device according to claim 13, wherein said pumping means of said compressor unit comprise a bell shaped membrane having a bell axis and lateral walls encircling a box-like valve body and a vibrating disk-like top wall extending transverse to said bell axis and wherein said mechanical transmission means impart a vibration of said top wall in the direction of said bell axis and wherein said electric motor has a rotation axis perpendicular to said bell axis.

20. A device according to claim 13, wherein said pumping means of said compressor unit comprise a box-like compression chamber having a top cover in the form of a membrane and valve means for air admission and delivery, an eccentric mass supported at leat partially onto said mebrane and said electric motor imparting rotatory motion to said eccentric mass thereby to create vibrations transmitted to said membrane.

* * * * *